US009313598B2

(12) United States Patent
Ramteke

(10) Patent No.: US 9,313,598 B2
(45) Date of Patent: Apr. 12, 2016

(54) METHOD AND APPARATUS FOR STEREO TO FIVE CHANNEL UPMIX

(75) Inventor: Mithil Ramteke, Bangalore (IN)

(73) Assignee: Nokia Technologies Oy, Espoo (FI)

( * ) Notice: Subject to any disclaimer, the term of this patent is extended or adjusted under 35 U.S.C. 154(b) by 706 days.

(21) Appl. No.: 13/579,561

(22) PCT Filed: Mar. 2, 2011

(86) PCT No.: PCT/IB2011/050893
§ 371 (c)(1),
(2), (4) Date: Aug. 16, 2012

(87) PCT Pub. No.: WO2011/107951
PCT Pub. Date: Sep. 9, 2011

(65) Prior Publication Data

US 2012/0308015 A1 Dec. 6, 2012

(30) Foreign Application Priority Data

Mar. 2, 2010 (IN) ..... 452/DEL/2010

(51) Int. Cl.
*H04S 3/02* (2006.01)
*G10L 19/008* (2013.01)

(52) U.S. Cl.
CPC *H04S 3/02* (2013.01); *G10L 19/008* (2013.01)

(58) Field of Classification Search
USPC ..... 381/17–23
See application file for complete search history.

(56) References Cited

U.S. PATENT DOCUMENTS

| | | | | |
|---|---|---|---|---|
| 6,882,731 | B2 | 4/2005 | Irwan et al. | |
| 7,542,815 | B1 * | 6/2009 | Berchin | 700/94 |
| 2007/0041592 | A1 | 2/2007 | Avendano et al. | |
| 2008/0175394 | A1 | 7/2008 | Goodwin | |
| 2009/0080666 | A1 * | 3/2009 | Uhle et al. | 381/17 |
| 2009/0110203 | A1 | 4/2009 | Taleb | |
| 2009/0222272 | A1 | 9/2009 | Seefeldt et al. | |

FOREIGN PATENT DOCUMENTS

WO 2008/049587 A1 5/2008

OTHER PUBLICATIONS

D. Lee and H. Seung, "Algorithms for Non-negative Matrix Factorization", 2001, MIT Press, 556-562.*

V. Jain and R. Crochiere, "Quadrature Mirror Filter Design in the Time Domain", Apr. 1984, IEEE, IEEE Transactions on Acoustics, Speech, and Signal Processing, vol. ASSP-32, No. 2, 353-361.*

(Continued)

*Primary Examiner* — Curtis Kuntz
*Assistant Examiner* — Kenny Truong
(74) *Attorney, Agent, or Firm* — Alston & Bird LLP

(57) ABSTRACT

An apparatus comprising at least one processor and at least one memory including computer program code The at least one memory and the computer program code is configured to, with the at least one processor, cause the apparatus at least to perform determining a covariance matrix for at least one frequency band of a first and a second audio signal, non-negative factorizing the covariance matrix to determine at least one first weighting value and at least one second weighting value associated with the at least one frequency band; and determining a third audio signal associated with the at least one frequency band by combining the first weighting value and the first audio signal to the second weighting value and the second audio signal.

20 Claims, 11 Drawing Sheets

(56) References Cited

OTHER PUBLICATIONS

C. Uhle, A. Walther, and O. Hellmuth, Ambience Seperation from Mono Recordings using Non-negative Matrix Factorization, AES 30th International Conference, Saariselka, Finalnd, Mar. 15-17, 2007 1-8.*
R. Irwan and R. Aarts, "Two-to-Five Channel Sound Processing", Nov. 2002, J. Audio Eng. Soc., vol. 50, No. 11, 914-926.*
Extended European Search Report received for corresponding European Patent Application No. 11750271.6, dated Feb. 10, 2014, 8 pages.
Avendano et al., "A Frequency Domain Approach to Multi-Channel Upmix", Journal of the Audio Engineering Society, vol. 52, Issue 7/8, Jul.-Aug. 2004, pp. 740-749.
Irwan et al., "Two-to-Five Channel Sound Processing", Journal of the Audio Engineering Society, vol. 50, Issue 11, Nov. 2002, pp. 914-926.
Driessen et al., "An Unsupervised Adaptive Filtering Approach of 2-To-5 Channel Upmix", 119th Audio Engineering Society Convention, Oct. 7-10, 2005, 7 pages.
Uhle et al., "Ambience Separation from Mono Recordings using Non-negative Matrix Factorization", AES 30th International Conference, Mar. 15-17, 2007, pp. 1-8.
Lee et al., "Algorithms for Non-Negative Matrix Factorization", In NIPS, vol. 13, 2000, 7 pages.
Lee et al., "Learning the Parts of Objects by Non-Negative Matrix Factorization", Nature, vol. 401, Oct. 21, 1999, pp. 788-791.
Li et al., "Learning Spatially Localized, Parts-Based Representation", Proceedings of the 2001 IEEE Computer Society Conference on Computer Vision and Pattern Recognition, vol. 1, 2001, pp. 1-6.
Blondel et al., "Weighted Nonnegative Matrix Factorization and Face Feature Extraction", Preprint submitted to Image and Vision Computing, Mar. 2007, pp. 1-17.
Princen, "The Design of Nonuniform Modulated Filter Banks", IEEE Transactions on Signal Processing, vol. 43, Issue 11, Nov. 1995, pp. 2550-2560.
Nguyen, "Near-Perfect-Reconstruction Pseudo-QMF Banks", IEEE Transactions on Signal Processing, vol. 42, Issue 1, Jan. 1994, pp. 65-76.
Vetterli et al., "Perfect Reconstruction FIR Filter Banks: Some Properties and Factorizations", IEEE Transactions on Acoustics, Speech and Signal Processing, vol. 37, Issue 7, Jul. 1989, pp. 1057-1071.
Cvetkovic et al., "Nonuniform Oversampled Filter Banks for Audio Signal Processing", IEEE Transactions on Speech and Audio Processing, vol. 11, Issue 5, Sep. 2003, pp. 393-399.
Harma et al., "Frequecny Warped Signal Processing for Audio Applications", Journal of the Audio Engineering Society, vol. 48, Issue 11, Nov. 2000, pp. 1011-1031.
Burred et al., "Comparison of Frequency-Warped Representations for Source Separation of Stereo Mixtures", Audio Engineering Society 121st Convention, Convention Paper 6924, Oct. 5-8, 2006, pp. 1-8.
Uhle et al., "A Supervised Learning Approach to Ambience Extraction from Mono Recordings for Blind Upmixing", Proceedings of the 11th International Conference on Digital Audio Effects, Sep. 1-4, 2008, 8 pages.
Bai et al., "Upmixing and Downmixing Two-Channel Stereo Audio for Consumer Electronics", IEEE Transactions on Consumer Electronics, vol. 53, Issue 3, Aug. 2007, pp. 1011-1019.
International Search Report and Written Opinion received for corresponding International Patent Application No. PCT/IB2011/050893, dated Jun. 29, 2011, 12 pages.
Ozerov et al., "Multichannel Nonnegative Matrix Factorization in Convolutive Mixtures for Audio Source Separation", IEEE Transactions on Audio, Speech, and Language Processing, vol. 18, Issue 3, Mar. 2010, pp. 550-563.

* cited by examiner

METHOD AND APPARATUS FOR STEREO TO FIVE CHANNEL UPMIX

RELATED APPLICATION

This application was originally filed as PCT Application No. PCT/IB2011/050893 filed Mar. 2, 2011 which claims priority benefit to Indian Patent Application No. 452/DEL/2010, filed Mar. 2, 2010.

TECHNOLOGICAL FIELD

The present invention relates to apparatus for processing of audio signals. The invention further relates to, but is not limited to, apparatus for processing audio and speech signals in audio playback devices.

BACKGROUND

Audio rendering and sound virtualization has been a growing area in recent years. There are different playback techniques some of which are mono, stereo playback, surround 5.1, ambisonics etc. In addition to playback techniques, apparatus or signal processing integrated within apparatus or signal processing performed prior to the final playback apparatus has been designed to allow a virtual sound image to be created in many applications such as music playback, movie sound tracks, 3D audio, and gaming applications.

The standard for commercial audio content until recently, for music or movie, was stereo audio signal generation. Signals from different musical instruments, speech or voice, and other audio sources creating the sound scene were combined to form a stereo signal. Commercially available playback devices would typically have two loudspeakers placed at a suitable distance in front of the listener. The goal of stereo rendering was limited to creating phantom images at a position between the two speakers and is known as panned stereo. The same content could be played on portable playback devices as well, as it relied on a headphone or an earplug which uses 2 channels. Furthermore the use of stereo widening and 3D audio applications have recently become more popular especially for portable devices with audio playback capabilities. There are various techniques for these applications that provide user spatial feeling and 3D audio content. The techniques employ various signal processing algorithms and filters. It is known that the effectiveness of spatial audio is stronger over headphone playback.

Commercial audio today boasts of 5.1, 7.1 and 10.1 multichannel content where 5, 7 or 10 channels are used to generate surrounding audio scenery. An example of a 5.1 multichannel system is shown in FIG. 2 where the user 211 is surrounded by a front left channel speaker 251, a front right channel speaker 253, a centre channel speaker 255, a left surround channel speaker 257 and a right surround channel speaker 259. Phantom images can be created using this type of setup lying anywhere on the circle 271 as shown in FIG. 2. Furthermore a channel in multichannel audio is not necessarily unique. Audio signals for one channel after frequency dependent phase shifts and magnitude modifications can become the audio signal for a different channel. This in a way helps to create phantom audio sources around the listener leading to a surround sound experience. However such equipment is expensive and many end users do not have the multiloudspeaker equipment for replaying the multichannel audio content. To enable multichannel audio signals to be played on previous generation stereo playback systems, the multichannel audio signals are matrix downmixed.

After the downmix the original multi-channel content is no longer available in its component form (each component being each channel in say 5.1).

Researchers have attempted to use various techniques to extract the multiple channels from stereo recordings. However, these are typically both computationally intensive and also highly dependent on a sparse distribution of the sources in a particularly time frequency domain. However this is problematic as sparsity of sources does not occur for certain sound scenes.

Some researchers have attempted to use a mathematical tool known as principal component analysis (PCA) which attempts to extract the principal component or coherent sound source from a stereo signal. The principal components are then passed through a decoder for the extraction of the various channels required.

However PCA approaches for primary and ambient decomposition of the stereo signal, rely on generation of two weights from the principal vector computed from the singular value decomposition of the covariance matrix, is computationally expensive. In such systems the singular value decomposition provides a low rank approximation to the matrix using its dominant Eigenvectors and Eigenvalues. The low rank approximation computed using the Eigenvectors minimises the Euclidean norm cost function between the matrix and its low rank version. Minimising the Euclidean norm as the cost function to obtain a low rank matrix to a 2×2 covariant matrix only takes into account the minimum mean square error between the individual elements.

This invention proceeds from the consideration that by using non-negative matrix factorisation (NMF) it is possible to obtain a rank 1 approximation to the covariance matrix. Furthermore it is also possible to obtain a low rank approximation to the covariance matrix for cost functions other than the Euclidean norm which further improves upon the accuracy of the audio channel identification and extraction process.

BRIEF SUMMARY

Embodiments of the present invention aim to address the above problem.

There is provided according to a first aspect of the invention a method comprising: determining a covariance matrix for at least one frequency band of a first and a second audio signal; non-negative factorizing the covariance matrix to determine at least one first weighting value and at least one second weighting value associated with the at least one frequency band; and determining a third audio signal associated with the at least one frequency band by combining the first weighting value and the first audio signal to the second weighting value and the second audio signal. The method may further comprise: determining a fourth audio signal associated with the at least one frequency band by subtracting the third audio signal from the first audio signal; and determining a fifth audio signal associated with the at least one frequency band by subtracting the third audio signal from the second audio signal.

The fourth audio signal may be a left channel audio signal, the fifth audio signal may be a right channel audio signal, the third channel may be a centre channel audio signal, the first audio signal may be a left stereo audio signal, and the second audio signal may be a right stereo audio signal.

The method may further comprise: determining an ambient audio signal associated with the at least one frequency band by subtracting the product of the second weighting value and the first audio signal from the product of the first weighting value and the second audio signal.

The method may further comprise: determining a left surround and right surround audio signal associated with the at least one frequency band by comb filtering the ambient audio signal associated with the at least one frequency band.

The method may further comprise: filtering each of the first and second audio signals to generate a lower and upper frequency part for each of the first and second audio signals; generating at least one frequency band from the lower frequency part for each of the first and second audio signals.

The method may further comprise: determining a third audio signal associated with the upper frequency part of the first and second audio signals by combining the product of at least one first weighting value associated with the at least one frequency band and the first audio signal associated with the upper frequency part to the at least one second weighting value associated with the at least one frequency band and the second audio signal associated with the upper frequency part.

The method may further comprise: combining the third audio signal associated with the upper frequency part with the third audio signal associated with the at least one frequency band.

The non-negative factorizing the covariance matrix to determine at least one first weighting value and at least one second weighting value associated with the at least one frequency band may comprise at least one of: a non-negative factorization with a minimisation of a Euclidean distance; and a non-negative factorization with a minimisation of a divergent cost function.

The non-negative factorizing the covariance matrix may generate the factors WH and wherein the at least one first weighting value and at least one second weighting value are preferably the first and second columns of the conjugate transposed W vector.

According to a second aspect of the invention there is provided an apparatus comprising at least one processor and at least one memory including computer program code the at least one memory and the computer program code configured to, with the at least one processor, cause the apparatus at least to perform: determining a covariance matrix for at least one frequency band of a first and a second audio signal; non-negative factorizing the covariance matrix to determine at least one first weighting value and at least one second weighting value associated with the at least one frequency band; and determining a third audio signal associated with the at least one frequency band by combining the first weighting value and the first audio signal to the second weighting value and the second audio signal.

The apparatus may be further caused to perform: determining a fourth audio signal associated with the at least one frequency band by subtracting the third audio signal from the first audio signal; and determining a fifth audio signal associated with the at least one frequency band by subtracting the third audio signal from the second audio signal.

The fourth audio signal may be a left channel audio signal, the fifth audio signal may be a right channel audio signal, the third channel may be a centre channel audio signal, the first audio signal may be a left stereo audio signal, and the second audio signal may be a right stereo audio signal.

The apparatus may be further caused to perform: determining an ambient audio signal associated with the at least one frequency band by subtracting the product of the second weighting value and the first audio signal from the product of the first weighting value and the second audio signal.

The apparatus may be further caused to perform: determining a left surround and right surround audio signal associated with the at least one frequency band by comb filtering the ambient audio signal associated with the at least one frequency band.

The apparatus may be further caused to perform: filtering each of the first and second audio signals to generate a lower and upper frequency part for each of the first and second audio signals; generating at least one frequency band from the lower frequency part for each of the first and second audio signals.

The apparatus may be further caused to perform: determining a third audio signal associated with the upper frequency part of the first and second audio signals by combining the product of at least one first weighting value associated with the at least one frequency band and the first audio signal associated with the upper frequency part to the at least one second weighting value associated with the at least one frequency band and the second audio signal associated with the upper frequency part.

The apparatus may be further caused to perform: combining the third audio signal associated with the upper frequency part with the third audio signal associated with the at least one frequency band.

The apparatus caused to perform the non-negative factorizing the covariance matrix to determine at least one first weighting value and at least one second weighting value associated with the at least one frequency band may be further caused to perform at least one of: a non-negative factorization with a minimisation of a Euclidean distance; and a non-negative factorization with a minimisation of a divergent cost function.

The apparatus caused to perform the non-negative factorizing the covariance matrix further may be caused to perform: generating the factors WH and wherein the at least one first weighting value and at least one second weighting value may be the first and second columns of the conjugate transposed W vector.

According to a third aspect of the invention there is provided an apparatus comprising: a covariance estimator configured to determine a covariance matrix for at least one frequency band of a first and a second audio signal; a non-negative factor determiner configured to non-negative factorize the covariance matrix to determine at least one first weighting value and at least one second weighting value associated with the at least one frequency band; and weighted signal combiner configured to determine a third audio signal associated with the at least one frequency band by combining the first weighting value and the first audio signal to the second weighting value and the second audio signal.

The apparatus may further comprise: a difference processor further configured to determine a fourth audio signal associated with the at least one frequency band by subtracting the third audio signal from the first audio signal; and a second difference processor configured to determine a fifth audio signal associated with the at least one frequency band by subtracting the third audio signal from the second audio signal.

The fourth audio signal may be a left channel audio signal, the fifth audio signal may be a right channel audio signal, the third channel may be a centre channel audio signal, the first audio signal may be a left stereo audio signal, and the second audio signal may be a right stereo audio signal.

The apparatus may further comprise: an weighted signal subtractor configured to determine an ambient audio signal associated with the at least one frequency band by subtracting the product of the second weighting value and the first audio signal from the product of the first weighting value and the second audio signal.

The apparatus may further comprise a left and right channel comb filter configured to determine by filtering the ambient audio signal a left surround and right surround audio signal associated with the at least one frequency band respectively.

The apparatus may further comprise: a quadrature mirror filter configured to filter each of the first and second audio signals to generate a lower and upper frequency part for each of the first and second audio signals; and an analysis filter configured to generate at least one frequency band from the lower frequency part for each of the first and second audio signals.

The apparatus may further comprise: a second weighted signal combiner configured to determine a third audio signal associated with the upper frequency part of the first and second audio signals by combining the product of at least one first weighting value associated with the at least one frequency band and the first audio signal associated with the upper frequency part to the at least one second weighting value associated with the at least one frequency band and the second audio signal associated with the upper frequency part.

The apparatus may further comprise a signal combiner configured to combine the third audio signal associated with the upper frequency part with the third audio signal associated with the at least one frequency band.

The non-negative factor determiner may further comprise at least one of: a non-negative factor determiner configured to minimise a Euclidean distance between the factors WH and covariance matrix; and a non-negative factor determiner configured to minimise a divergent cost function between the factors WH and covariance matrix.

The non-negative factor determiner may comprise: a factor estimator configured to generate the factors WH; a conjugate processor configured to conjugate transpose the W vector; and a column reader configured to determine the at least one first weighting value as the first column of the conjugate transpose of the W vector and the at least one second weighting value as the second column of the conjugate transpose of the W vector.

According to a fourth aspect of the invention there is provided a computer-readable medium encoded with instructions that, when executed by a computer perform: determining a covariance matrix for at least one frequency band of a first and a second audio signal; non-negative factorizing the covariance matrix to determine at least one first weighting value and at least one second weighting value associated with the at least one frequency band; and determining a third audio signal associated with the at least one frequency band by combining the first weighting value and the first audio signal to the second weighting value and the second audio signal.

According to a fifth aspect of the invention there is provided an apparatus comprising: processing means configured to determine a covariance matrix for at least one frequency band of a first and a second audio signal; a further processing means configured to non-negative factorize the covariance matrix to determine at least one first weighting value and at least one second weighting value associated with the at least one frequency band; and audio signal processor configured to determine a third audio signal associated with the at least one frequency band by combining the first weighting value and the first audio signal to the second weighting value and the second audio signal.

An electronic device may comprise apparatus as described above.

A chipset may comprise apparatus as described above.

BRIEF DESCRIPTION OF DRAWINGS

For better understanding of the present invention, reference will now be made by way of example to the accompanying drawings in which.

DETAILED DESCRIPTION OF THE DRAWINGS

Figure 1:
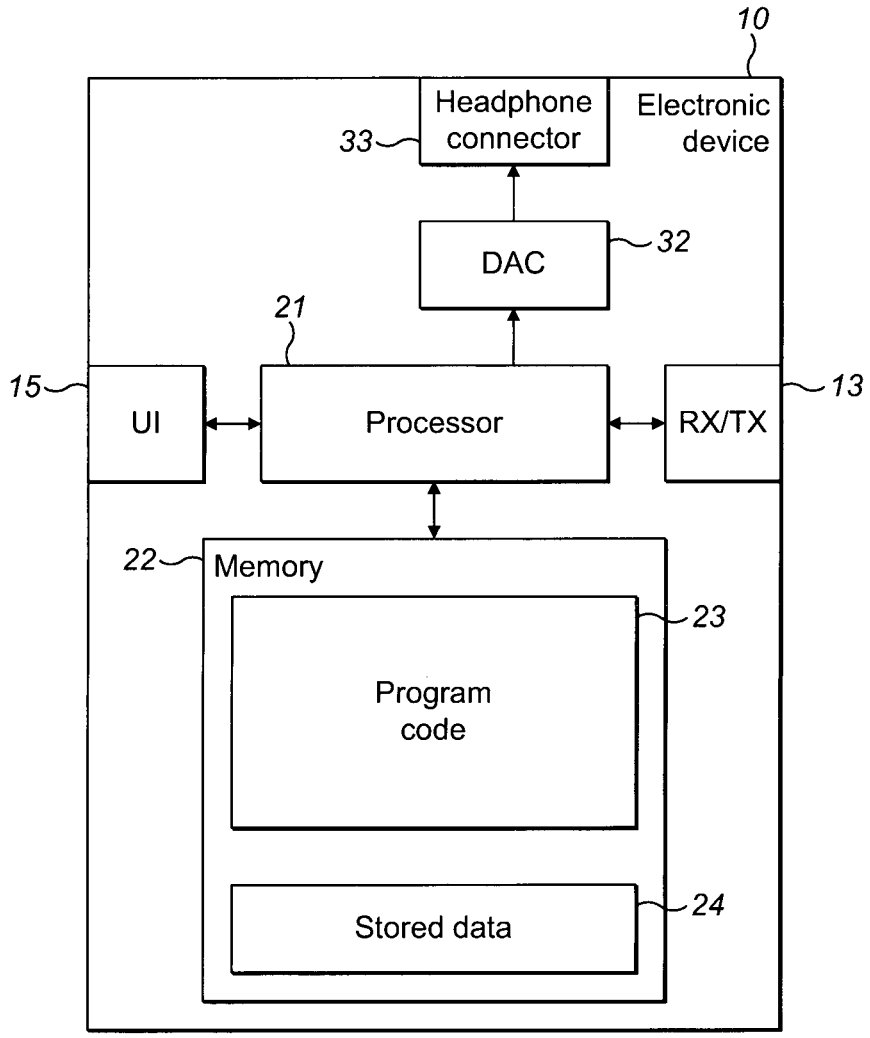
FIG. 1 shows schematically an electronic device employing embodiments of the application.

The following describes apparatus and methods for the provision of enhancing channel extraction. In this regard reference is first made to FIG. 1 schematic block diagram of an exemplary electronic device 10 or apparatus, which may incorporate a channel extractor. The channel extracted by the centre channel extractor in some embodiments is suitable for an up-mixer.

The electronic device 10 may for example be a mobile terminal or user equipment for a wireless communication system. In other embodiments the electronic device may be a Television (TV) receiver, portable digital versatile disc (DVD) player, or audio player such as an ipod.

The electronic device 10 comprises a processor 21 which may be linked via a digital-to-analogue converter 32 to a headphone connector for receiving a headphone or headset 33. The processor 21 is further linked to a transceiver (TX/RX) 13, to a user interface (UI) 15 and to a memory 22.

The processor 21 may be configured to execute various program codes. The implemented program codes comprise a channel extractor for extracting multichannel audio signal from a stereo audio signal. The implemented program codes 23 may be stored for example in the memory 22 for retrieval by the processor 21 whenever needed. The memory 22 could further provide a section 24 for storing data, for example data that has been processed in accordance with the embodiments.

The channel extracting code may in embodiments be implemented at least partially in hardware or firmware.

The user interface 15 enables a user to input commands to the electronic device 10, for example via a keypad, and/or to obtain information from the electronic device 10, for example via a display. The transceiver 13 enables a communication with other electronic devices, for example via a wireless communication network.

It is to be understood again that the structure of the electronic device 10 could be supplemented and varied in many ways.

The apparatus 10 may in some embodiments further comprise at least two microphones for inputting audio or speech that is to be processed according to embodiments of the application or transmitted to some other electronic device or stored in the data section 24 of the memory 22. A corresponding application to capture stereo audio signals using the at least two microphones may be activated to this end by the user via the user interface 15. The apparatus 10 in such embodiments may further comprise an analogue-to-digital converter configured to convert the input analogue audio signal into a digital audio signal and provide the digital audio signal to the processor 21.

The apparatus 10 may in some embodiments also receive a bit stream with correspondingly encoded stereo audio data from another electronic device via the transceiver 13. In these embodiments, the processor 21 may execute the channel extraction program code stored in the memory 22. The processor 21 in these embodiments may process the received stereo audio signal data, and output the extracted channel data.

In some embodiments the headphone connector 33 may be configured to communicate to a headphone set or earplugs wirelessly, for example by a Bluetooth profile, or using a conventional wired connection.

The received stereo audio data may in some embodiments also be stored, instead of being processed immediately, in the data section 24 of the memory 22, for instance for enabling a later processing and presentation or forwarding to still another electronic device.

Figure 3:
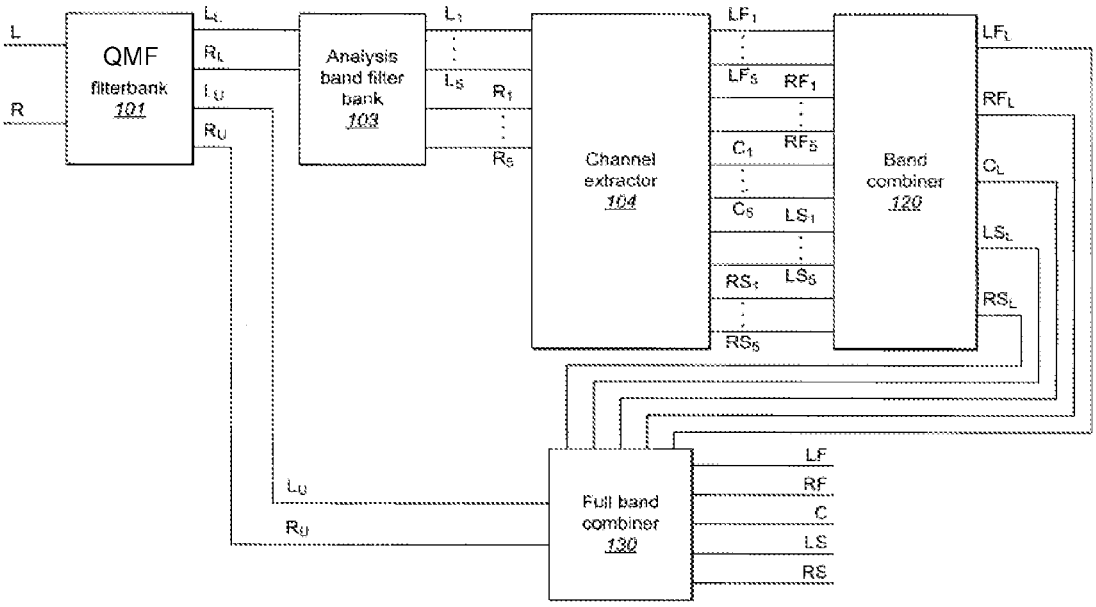
FIG. 3 shows schematically a stereo to multichannel up-mixer according to some embodiments of the application.
Figure 4:
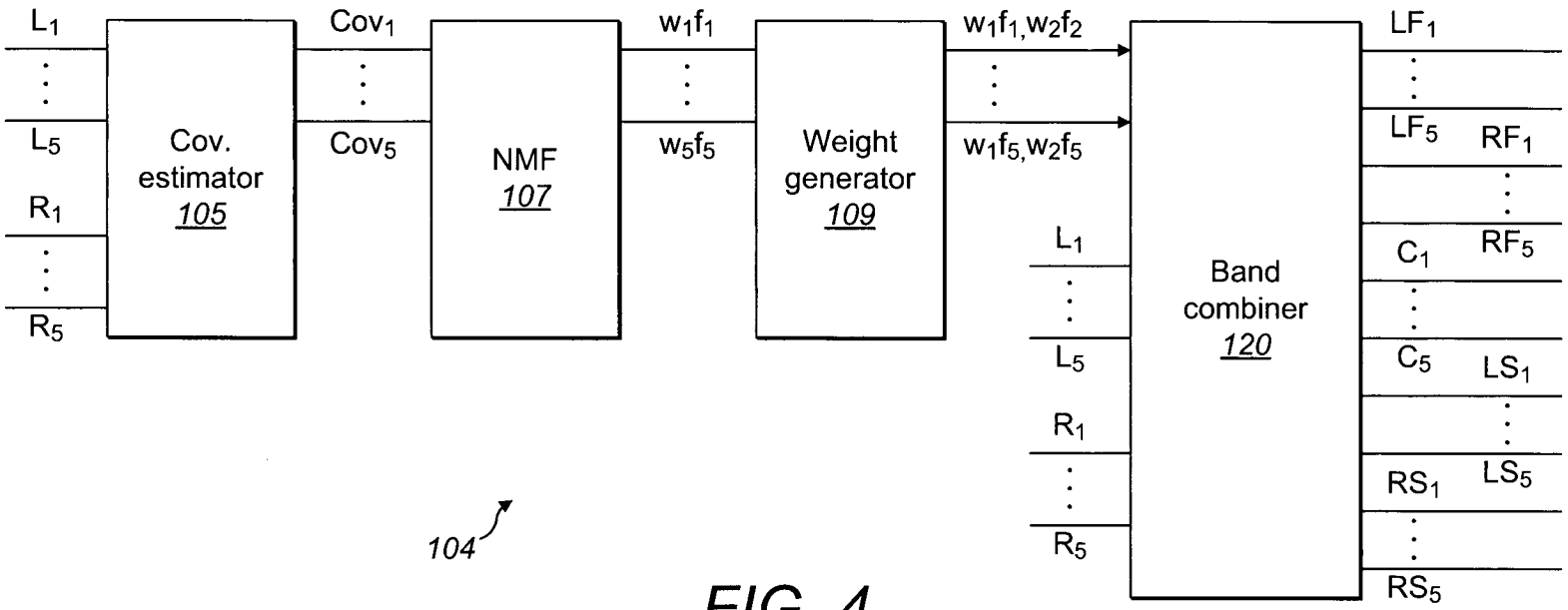
FIG. 4 shows schematically a channel extractor as shown in FIG. 3 according to some embodiments of the application.
Figure 5:
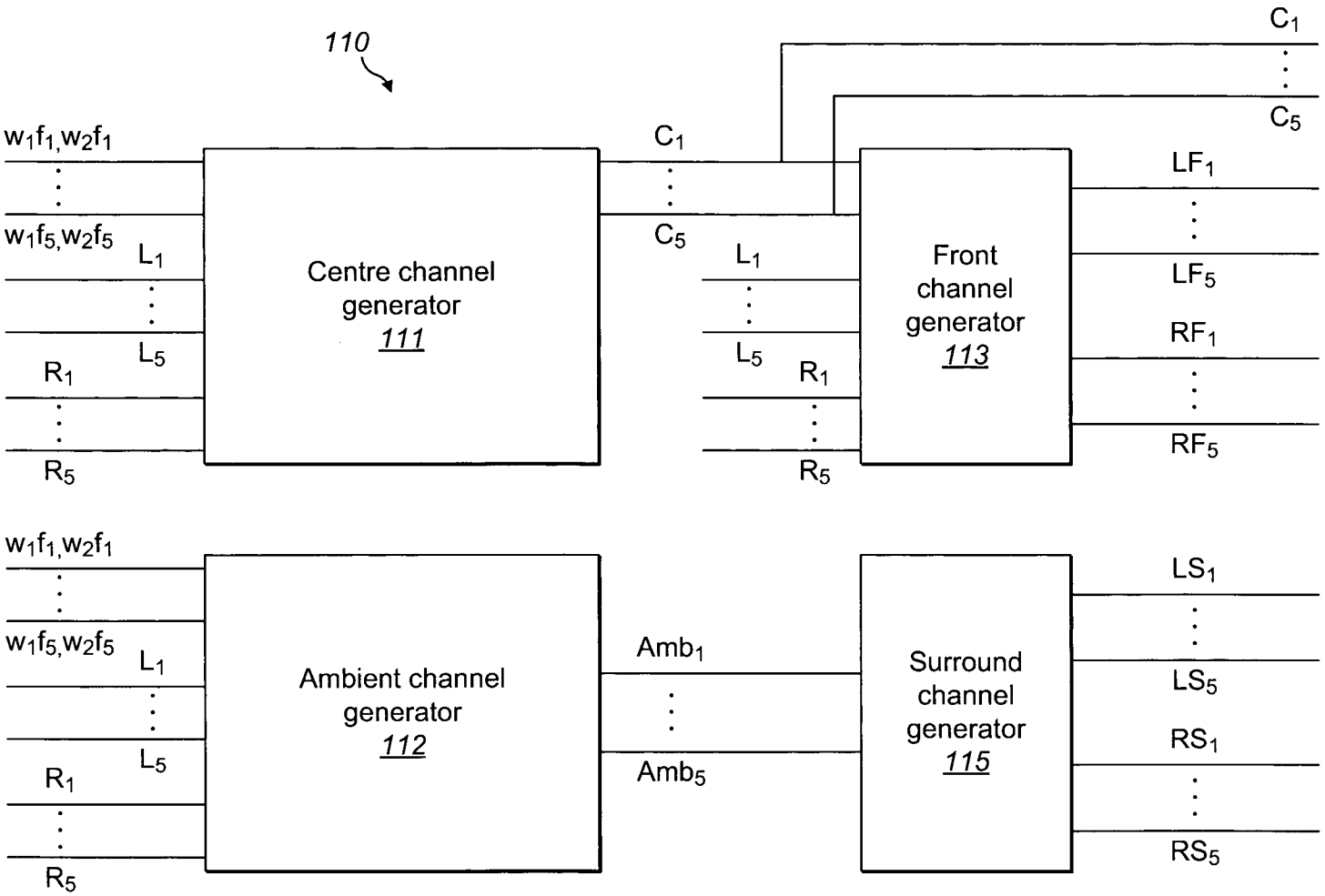
FIG. 5 shows schematically a channel generator as shown in FIG. 4 according to some embodiments of the application.

It would be appreciated that the schematic structures described in FIGS. 3 to 5 and the method steps in FIGS. 6 to 9 represent only a part of the operation of a complete audio processing chain comprising some embodiments as exemplarily shown implemented in the electronic device shown in FIG. 1.

FIG. 3 shows in further detail a multi channel extractor as part of an up-mixer 106 suitable for the implementation of some embodiments of the application. The up-mixer 106 is configured to receive a stereo audio signal and generate a left front, centre, right front, left surround and right surround channel which may be generated from the extracted centre channel and ambient channel.

The up-mixer 106 is configured to receive the left channel audio signal and the right channel audio signal. The up-mixer 106 comprises in some embodiments a quadrature mirror filterbank (QMF) 101. The QMF 101 is configured to separate the input audio channels into upper and lower frequency parts and to then output the lower part for the left and right channels for further analysis. Any suitable QMF structure may be used, for example a lattice filter bank implementation may be used.

The left and right channel lower frequency components in the time domain are then passed to the analysis band filterbank 103.

Figure 6:
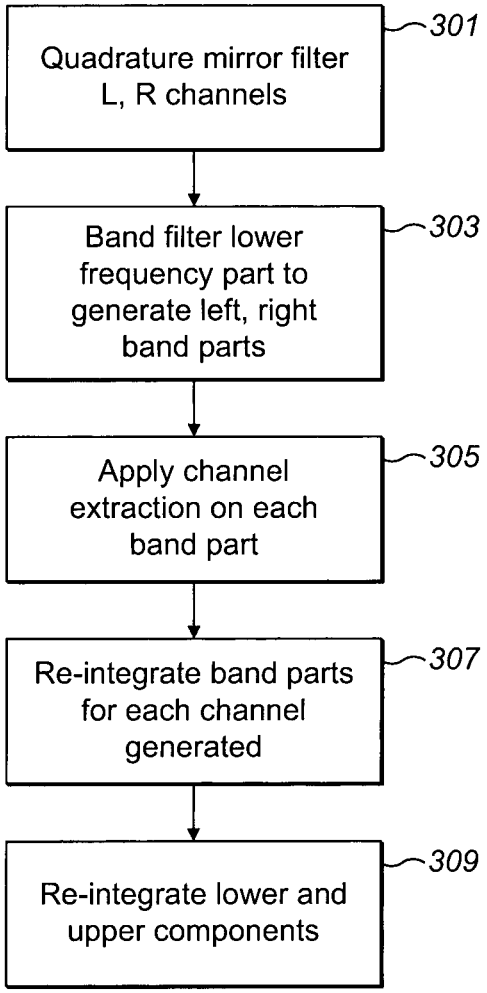
FIG. 6 shows a flow diagram illustrating the operation of the multichannel up-mixer according to some embodiments of the application.

The operation of quadrature mirror filtering the left and right channels to extract the low frequency sample components is shown in FIG. 6 by step 301.

The up-mixer 106 in some embodiments comprises an analysis band filter bank. The analysis band filter bank 103 is configured to receive the low frequency parts of the left and right stereo channels and further filter these to output a series of non-uniform bandwidth output bands, parts or bins. In some embodiments the analysis band filter bank 103 comprises a frequency warp filter such as described in Harmer et al "Frequency Warp Signal Processing for Audio Applications, Journal of Audio Engineering Society, Vol. 48, No. 11, November 2000, pages 1011-1031. However it would be understood that any suitable filter bank configuration may be used in other embodiments.

The frequency warped filter structure may for example have a 15 tap finite impulse response (FIR) filter prototype. In such embodiments the analysis band filterbank 103 outputs five band outputs each representing the time domain filtered output samples of each of the non-uniform bandwidth filter. It would be appreciated that although the following examples show 5 bands output to the covariance estimator it would be appreciated that any suitable number of bands may be generated and used. Furthermore in some embodiments the bands may be linear bands. In some further embodiments the bands may be at least partially overlapping frequency bands, contiguous frequency bands, or separate frequency bands.

Each of the bands time domain band filtered samples are passed to the channel extractor 104.

The application of the filterbank to generate frequency bins is shown in FIG. 6 by step 303.

Figure 2:
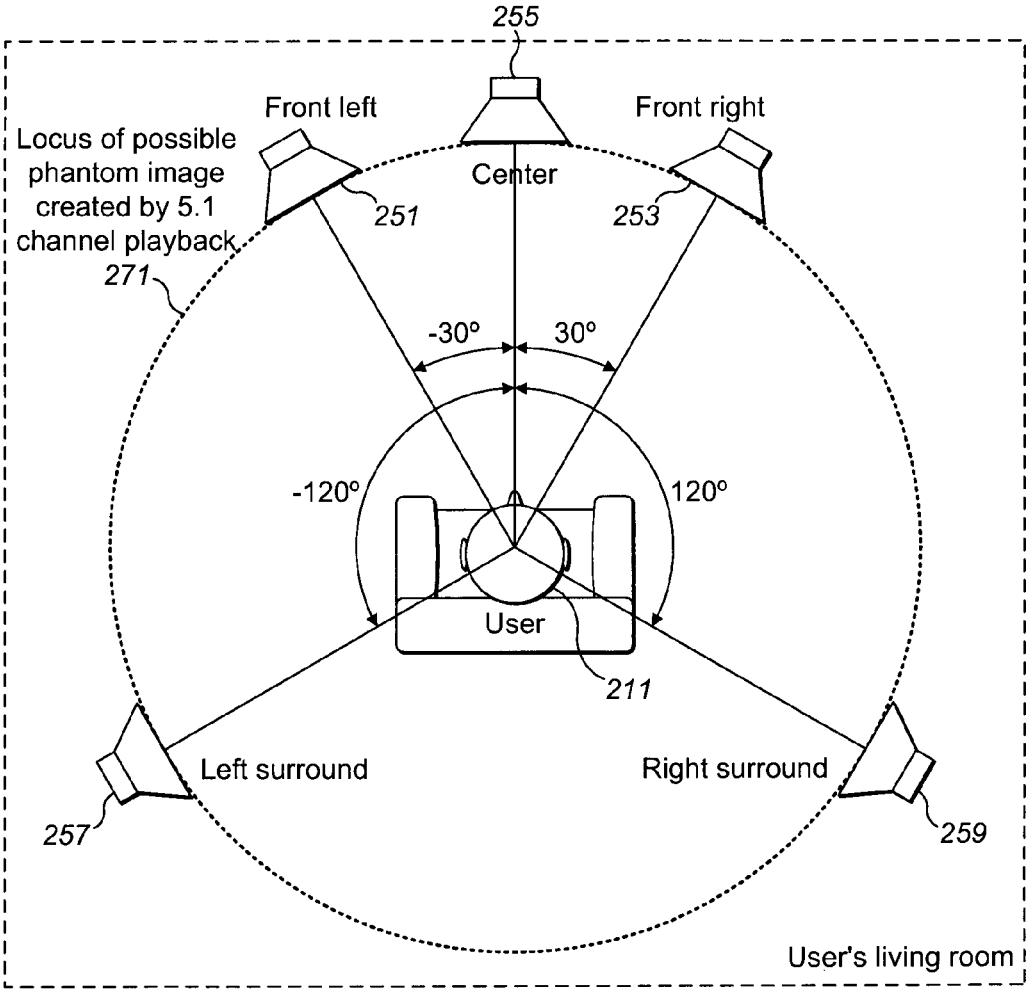
FIG. 2 shows schematically a 5 channel audio system configuration.

The channel extractor 104 is configured to receive the time domain band filtered outputs and generate for each band a series of channels. For the following examples the channel extractor 104 is configured to output five channels similar to those shown in FIG. 2—these being a Left Front (LF) channel, a Right Front (RF) channel, a Centre (C) channel, the Left Surround (LS) channel and the Right Surround (RS) channel.

The extraction of the series of channels is shown in FIG. 6 in step 305.

Figure 7:
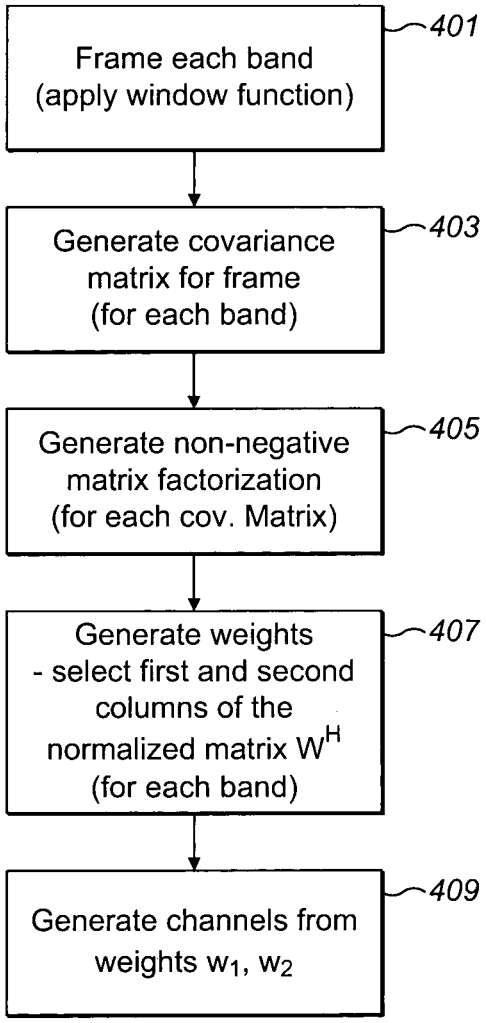
FIG. 7 shows a flow diagram illustrating the operation of the channel extractor according to some embodiments of the application.

With respect to FIG. 4 an example of the channel extractor 104 according to some embodiments is shown, and the operations of the example according to some embodiments is shown in FIG. 7.

The channel extractor 104 in some embodiments comprises a covariance estimator 105 configured to receive the time domain band filtered outputs and output a covariance matrix for each band. The covariance estimator 105 in some embodiments is configured to generate a covariance matrix for a number of samples for each frequency band received from the analysis band filter bank 103. In such embodiments therefore the covariance estimator 105 assembles a group of left channel samples which has been filtered, and an associated right channel sample group and generates the covariance matrix according to any suitable covariance matrix generation algorithm.

For example in some embodiment the covariance estimator generates a sample frame of left and associated right channel values. In some embodiments these frames may be 256 sample values long. Furthermore in some embodiments these frames overlap adjacent frames by 50%. In such embodiments a windowing filter function may be applied such as a Hanning window or any suitable windowing.

The operation of framing each band is shown in FIG. 7 by step 401.

The 2×2 covariance matrix across the left and right channel which is mathematically the expected value of the outer product of the vectors formed by the left and corresponding right samples may be depicted by the following equation:

$$\mathrm{Cov} = E\left(\begin{bmatrix} L \\ R \end{bmatrix}\begin{bmatrix} L & R \end{bmatrix}\right) = \begin{bmatrix} \sigma_L^2 & \rho\sigma_L\sigma_R \\ \rho\sigma_L\sigma_R & \sigma_R^2 \end{bmatrix}$$

where L is the left channel sample, R is the right channel sample, E ( ) is the expected value, $\sigma_L^2$ is the variance of the left channel, $\sigma_R^2$ is the variance of the right channel, and □ is the cross correlation coefficient between the left and right channel samples.

It would be understood from the structure of the covariance matrix that it is not an entirely positive matrix. However the non-negativity of the matrix would be governed by the sign of the cross-correlation coefficient □. The matrix C is non-negative if the cross correlation coefficient □ is non-negative. Also a negative value of the cross-correlation implies that the signal is not well localised and hence is an ambient signal. In other words no special processing is required when the cross-correlation coefficient is negative. However when the cross-correlation coefficient □□ is positive the matrix C is non-negative and it can now be applied to the non-negative matrix factorisation processor 107.

The covariance estimator 105 may then output the covariance matrix values to the non-negative matrix factorisation processor 107. The operation of generating for each band a covariance matrix for overlapping sample windows is shown in FIG. 7 by step 403.

The channel extractor 104 in some embodiments further comprises a non-negative matrix factorisation (NMF) processor 107. The non-negative matrix factorisation processor 107 receives the covariance matrix for each band and then applies a non-negative matrix factorization to each covariance matrix in order to determine matrix factorisations.

It would be understood that non-negative matrix factorisation is a technique through which a matrix with all positive entries is approximated as a product of two positive matrices. In other words it may be mathematically represented by the following:

$$V=WH.$$

In order to find an approximate factorisation, a cost function which quantifies the quality of the approximation may be applied. Two typical cost functions are the Euclidean distance between two matrices which may be mathematically defined as:

$$\|A-B\|^2=\sum_{i,j}(A_{i,j}-B_{i,j})^2,$$

where A and B are the two matrices being applied to the cost function, which in these embodiments are the covariance matrix (or V) and the product of the factorized matrices (WH). In some further embodiments the cost function may be the divergence between the two matrices A and B. The divergence may be defined by the following equation:

$$D(A\,\|\,B)=\sum_{ij}\left(A_{ij}\log\frac{A_{ij}}{B_{ij}}-A_{ij}+B_{ij}\right)$$

Like the Euclidean distance the divergence measure is also lower bounded by 0 and vanishes if and only if A is equal to B.

Thus in some embodiments where the Euclidean distance is the cost function and where the covariance matrix C is taken to be the non-negative matrix V and the non negative factors are W and H then the NMF processor 107 in these embodiments carries out the following two steps until there is no improvement in minimizing the cost function.

Step 1

$$H_{au}=H_{au}\frac{(W^TV)_{au}}{(W^TWH)_{au}},\text{ then}$$

Step 2

$$W_{ia}=W_{ia}\frac{(VH^T)_{ia}}{(WHH^T)_{ia}},$$

repeat step 1 until no improvement in cost function

However when the divergent cost function is used as the cost function then the NMF processor 107 in these embodiments applies the following two steps until there is no further improvement in minimizing the cost function.

Step 1

$$H_{au}=H_{au}\frac{\sum_i W_{ia}V_{iu}/(WH)_{iu}}{\sum_k W_{ka}},\text{ then}$$

Step 2

$$W_{ia}=W_{ia}\frac{\sum_u H_{au}V_{iu}/(WH)_{iu}}{\sum_v H_{av}},$$

repeat step 1 until no improvement in cost function

The indices i,a and u represent the indices of the elements of the matrix.

The vectors W and H, once computed, in some embodiments are passed to the weight generator 109. It would be understood that the above process is carried out on the covariance matrices for each of the bands. Furthermore in some embodiments other cost functions may be used in the non-negative factorization process. In some other embodiments different non-negative factorization cost functions may be used for covariance matrices of different bands.

The non-negative factorisation operation is shown in FIG. 7 by step 307.

The channel extractor 104 in some embodiments further comprises a weight generator 109. The weight generator 109 in some embodiments receives the non-negative matrix factors from the NMF processor 107 and outputs the weights $w_1$ and $w_2$ for each band. Thus for example where there are five bands as described in the example above the weight generator 109 outputs the weights $w_1f_1$ and $w_2f_1$ representing the first and second elements of the weight vectors for the first frequency band, $w_1f_2$ and $w_2f_2$ representing the first and the second elements of weight vectors for the second frequency band, $w_1f_3$ and $w_2f_3$ representing the first and the second elements of the weight vectors for the third frequency band, $w_1f_4$ and $w_2f_4$ representing the first and the second elements of the weight vectors for the fourth frequency band, and $w_1f_5$ and $w_2f_5$ representing the first and the second elements of the weight vectors for the fifth frequency band.

The weight generator 109 may in some embodiments generate the first and the second weights by respectively taking the first and second columns of the normalized version of the vector $W^H$. In such embodiments the normalized version required the norm of the vector W to unity.

In some embodiments the weight generator 109 uses a normalised version of the vectors W and H. For example where only the power terms are taken into account and the covariance matrix may be expressed as following:

$$\mathrm{Cov} = \begin{bmatrix} \sigma_L^2 & \rho\sigma_L\sigma_R \\ \rho\sigma_L\sigma_R & \sigma_R^2 \end{bmatrix} = \begin{bmatrix} \sigma_L \\ \sigma_R \end{bmatrix} [\sigma_L \quad \sigma_R]$$

Then the sum square error in the approximation is $2(1-\square)^2$. To obtain the weights $w_1$ and $w_2$ it is possible to normalise the vectors to unity norm as by the following operations:

$$w_1 = \left(\frac{\sigma_L}{\sqrt{\sigma_L^2 + \sigma_R^2}}\right)$$

$$w_2 = \left(\frac{\sigma_R}{\sqrt{\sigma_L^2 + \sigma_R^2}}\right)$$

The operation on generating the weights by the weight generator is shown in FIG. 7 by step 407.

In some embodiments, and as indicated above the values of $w_1$ and $w_2$ can be determined by the weight generator 109, directly from the band power values and without calculating the covariance or factorizing the covariance matrix by determining a power value for the left ($\sigma_L^2$) and right ($\sigma_R^2$) channel signals for each frame and then using the power values in the above equations to generate the $w_1$ and $w_2$ weight value.

The weight generator 109 in such embodiments outputs the weights to the channel generator 110.

The channel extractor 104 in some embodiments further comprises a channel generator 110 which is configured to receive the weights for each band, as well as the sample values for both the left and right channels for each band and output the front, centre and surround channels for each band.

The generation of the band channels is shown in FIG. 7 by step 409.

Figure 8:
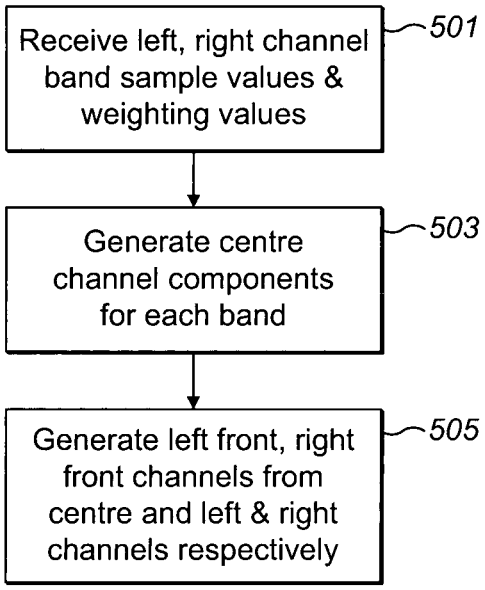
FIG. 8 shows a flow diagram illustrating some operations of the channel generator according to some embodiments of the application.
Figure 9:
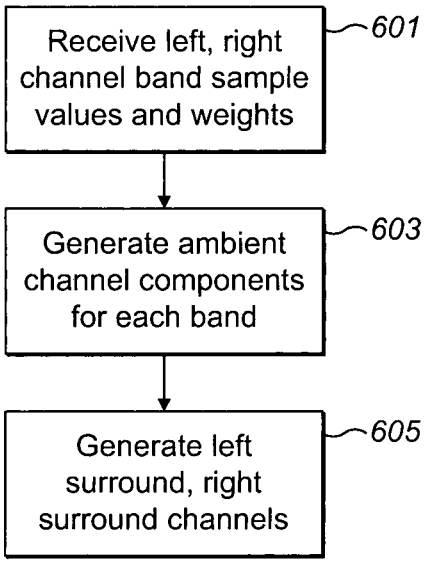
FIG. 9 shows a flow diagram illustrating some further operations of the channel generator according to some embodiments of the application.

With respect to FIG. 5 an example of the channel generator 110 according to some embodiments is shown, and the operations of the example according to some embodiments shown in FIGS. 8 and 9.

The channel generator 110 in some embodiments comprises a centre channel generator 111 configured to receive the weights $w_1$ and $w_2$ for each band or frequency band, the left channel band samples and the right channel band samples and from these generate the centre channel bands.

The receiving of the left, right and weights for each band is shown in FIG. 8 by step 503.

The centre channel generator 111 in some embodiments generates the centre channel by computing for each band the weighted addition of the left and right channel and multiplying it by a gain which is dependent on the angle the weight vectors ($w_1$, $w_2$) makes with the 45° line.

Figure 10:
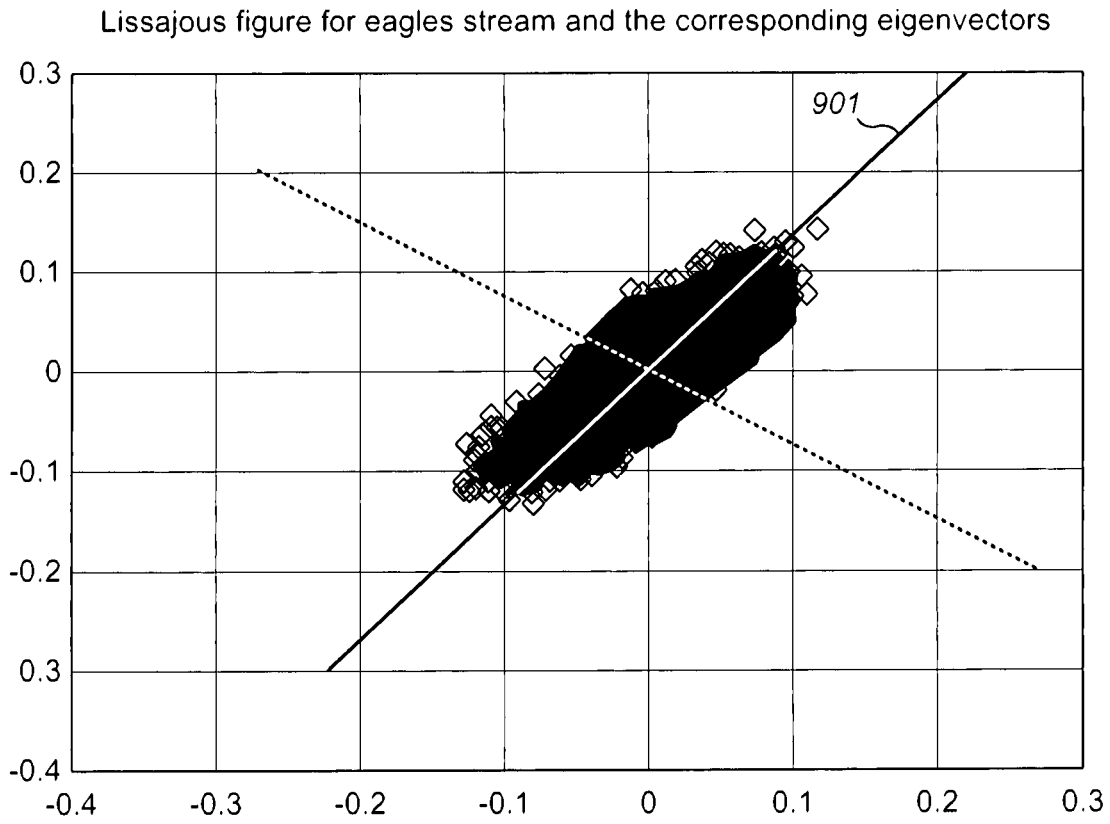
FIG. 10 shows a Lissajous figure of an example audio track and a corresponding weight vector direction estimation according to an embodiment of the application.

As can be seen in FIG. 10, the lissajous figure for a sample audio signal is shown from which the ray 901 passes through the co-ordinate defines by the weight vectors ($w_1$, $w_2$).

Hence the centre channel generator 111 in some embodiments can generate the centre channel C or cen for each band according to the following equation:

$$\mathrm{cen}=g*(w_1*L+w_2*R)$$

where $$g=\exp((w_1*0.707+w_2*0.707)-1)*\alpha$$

Figure 11:
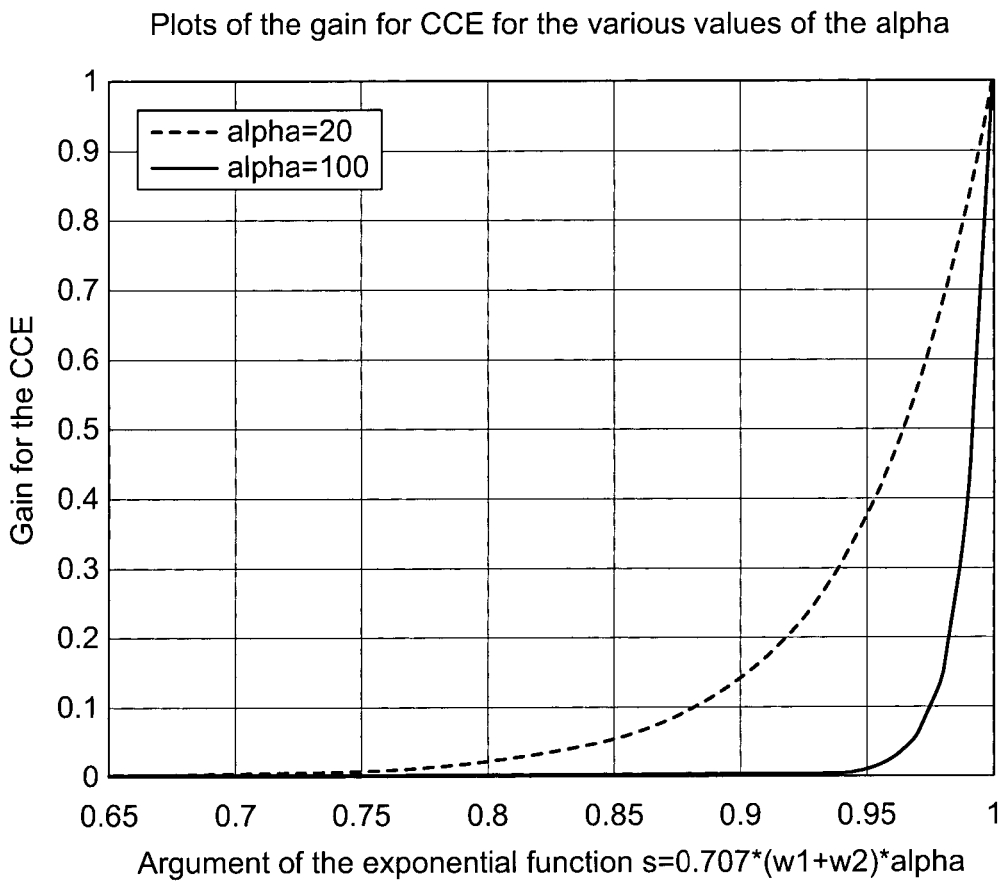
FIG. 11 shows a series of gain plots for the centre channel extraction for various example values of alpha.

The value of $\alpha$ governs the beam-width for the centre channel extraction. The distribution of the gain with respect to dot-product of the weights with the 45° vector for various angles of $\alpha$ (referred as alpha in the figure) is depicted in FIG. 11. The value of "$\alpha$" is a design parameter through which in some embodiments it is possible to have some degree of manual control on the channel generation operation. In such embodiments it can be possible to change the variation of the gain with respect to the argument of the exponential function mentioned above. In other words if a steep curve is required then a large value of $\alpha$ can be selected whereas if a flatter curve is required a smaller value of $\alpha$ can be selected.

The operation of generating a centre channel for each band is shown in FIG. 8 by step 503.

The centre channel values for each band in some embodiments may be output as the centre channel band values and also can be passed to the front channel generator 113.

The channel generator 110 in some embodiments further comprises a front channel generator 113. The front channel generator 113 in such embodiments can receive the centre channel and the left and right channel signals for each band and generate the left front (LF) and right front (RF) channels values for each band by combining the centre, left and right channels according to the following operations.

For example in some embodiments the front channel generator 113 is configured to generate the left front channel by subtracting the centre value from the left channel value, which may be represented mathematically as:

$$\mathrm{LF}_n=L_n-C_n.$$

Where n is the frequency band number.

Similarly the front channel generator 113 in some embodiments can generate right front band channel values by subtracting the centre channel value from the right channel value, which may be represented mathematically as:

$$\mathrm{RF}_n=R_n-C_n.$$

The operation of generating the left and right front channels is shown in FIG. 8 by step 505.

The operation of generating the centre and ambient channel signals is shown in FIG. 4 by step 311.

The channel generator 110 in some embodiments further comprises an ambient channel generator 112. The ambient channel generator 115 in some embodiments receives the weights $w_1$ and $w_2$ and the Left L and Right R channel values.

The operation of receiving these values is shown in FIG. 9 by step 601.

The ambient channel generator in these embodiments can generate the ambient channel values amb according to the following equation:

$$amb=w_2*L-w_1*R$$

The ambient channel values can then be passed to the surround channel generator 115.

The operation of generating the ambient channel values is shown in FIG. 9 by step 603.

Figure 12:
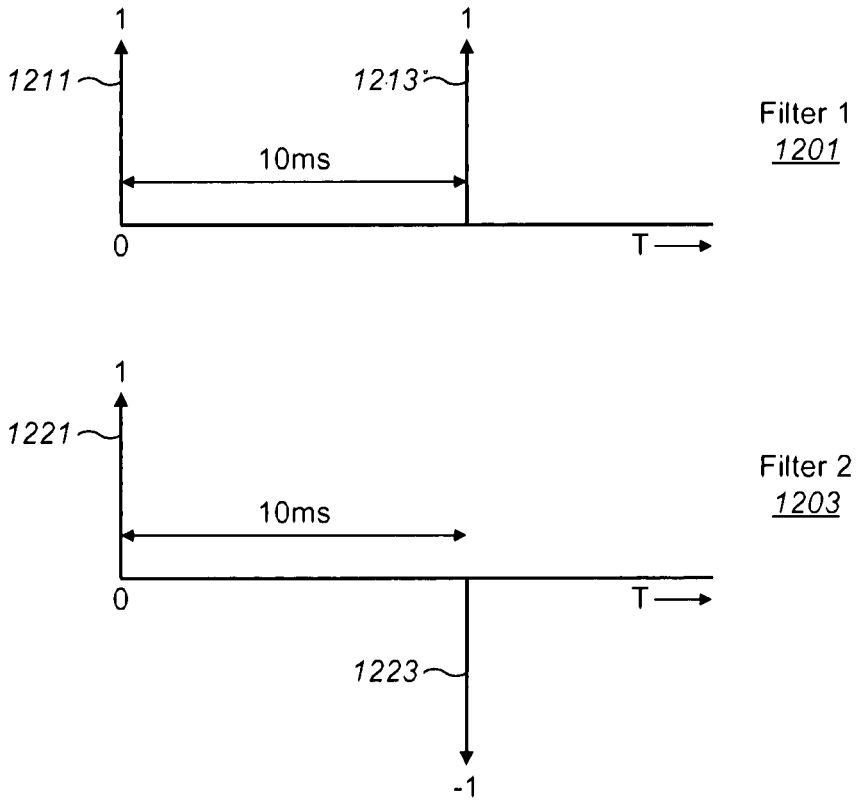
FIG. 12 shows a time response output for an example comb filter for the Left Surround and Right Surround outputs.

The channel generator 110 in some embodiments further comprises the surround channel generator 115. The surround channel generator receives the ambient channel and generates the left surround (LS) channel values and the right surround (RS) channel values. In some embodiments the surround channel generator 115 comprises of a pair of comb filters configured to receive the ambient channel values and generating a left surround and right surround signal. For example FIG. 12 shows the impulse response for a first and second comb filter configured to generate the left and right surround channel values respectively. The first filter 1201 as shown in FIG. 12 has a first impulse 1211 at t=0 of unity and a second impulse response 1213 at t=10 ms also of unity. The second filter 1203 as also shown in FIG. 12 has a first impulse 1221 at t=0 of unity and a second impulse 1223 at t=10 ms of negative unity. An example implementation of such filters can be found for example in Irwan and Aarts article "Two-to-Five Channel Sound Processing", Journal of Audio Engineering Society, Volume 50, No. 11, pages 914 to 926.

The left surround and right surround channel generation is shown in FIG. 9 by step 605.

The channel extractor 104 can then in some embodiments output each channel band values to the band combiner 120.

In some embodiments the up-mixer further comprises a band combiner 120 which receives the multiple channel signals for each band and combines the signals to create for each output channel a value which represents the lower frequency components.

The band combiner 120 in some embodiments thus may perform the inverse of the analysis band filter operation as carried out in the analysis band filter bank. In some embodiments, thus where the analysis band filter bank 103 performed a contiguous filtering operation the band combiner 120 may simply add the band values for each channel together to generate the values. It would be appreciated that where in some embodiments the analysis band filter bank 103 performs a re-sampling operation (for example a decimation operation) a further resampling operation (an upconversion) can be carried out by band combiner 120.

The output lower frequency components for each of the output channels can in some embodiments be output to the full band combiner 130.

The operation of re-integrating the band parts for the lower frequency components is shown in FIG. 6 by step 307.

In some embodiments the up-mixer further comprises a full band combiner 130 which receives the multiple channel signals for the lower frequency components and the upper frequency left and right input channels and generates a full frequency band output channel signal for each output channel. In some embodiments the QMF filterbank is configured to output the high frequency components to a five channel generator where a similar set of operations as described above are carried out on the high frequency bands as those already described for the lower frequency parts. In such embodiments the weights and the gain values calculated for the fifth or uppermost frequency band ($f_5$) of the lower frequency part are used for the higher frequency part. The generated channel signal components for the higher frequency parts can then be passed to the full band combiner 130 where for each channel the higher and lower frequency part signals can be passed through a QMF synthesis bank for generating for each channel a full band signal.

The operation of re-integrating the band parts for the lower frequency components is shown in FIG. 6 by step 307.

Thus in summary embodiments of the application perform a method comprising determining a covariance matrix for at least one frequency band of a first and a second audio signal, non-negative factorizing the covariance matrix to determine at least one first weighting value and at least one second weighting value associated with the at least one frequency band, and determining a third audio signal associated with the at least one frequency band by combining the first weighting value and the first audio signal to the second weighting value and the second audio signal.

Thus from the above apparatus and methods not only are the multiple surround channels generated, they are done so much more simpler than having to perform inverse matrix multiplications, and further provided a more flexible way to produce the weights which can be applied to generate the centre channel signal.

Although the above examples describe embodiments of the invention operating within an electronic device 10 or apparatus, it would be appreciated that the invention as described below may be implemented as part of any audio processor. Thus, for example, embodiments of the invention may be implemented in an audio processor which may implement audio processing over fixed or wired communication paths.

Thus user equipment may comprise an audio processor such as those described in embodiments of the invention above.

It shall be appreciated that the term electronic device and user equipment is intended to cover any suitable type of wireless user equipment, such as mobile telephones, portable data processing devices or portable web browsers.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

Thus at least some embodiments may be apparatus comprising: a covariance estimator configured to determine a covariance matrix for at least one frequency band of a first and a second audio signal; a non-negative factor determiner configured to non-negative factorize the covariance matrix to determine at least one first weighting value and at least one second weighting value associated with the at least one frequency band; and weighted signal combiner configured to determine a third audio signal associated with the at least one frequency band by combining the first weighting value and the first audio signal to the second weighting value and the second audio signal.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

Thus at least some embodiments may be a computer-readable medium encoded with instructions that, when executed by a computer perform: determining a covariance matrix for at least one frequency band of a first and a second audio signal; non-negative factorizing the covariance matrix to determine at least one first weighting value and at least one second weighting value associated with the at least one frequency band; and determining a third audio signal associated with the at least one frequency band by combining the first weighting value and the first audio signal to the second weighting value and the second audio signal.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or filmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. A method comprising:

determining a covariance matrix for at least one frequency band of a first and a second audio signal, wherein the covariance matrix comprises a cross correlation coefficient between the first and the second audio signal;

non-negative factorizing the covariance matrix, based on the cross correlation coefficient, to determine at least one first weighting value and at least one second weighting value associated with the at least one frequency band based on the cross correlation coefficient;

determining a third audio signal associated with the at least one frequency band by combining the first weighting value and the first audio signal to the second weighting value and the second audio signal, and generating a plurality of channels from the first weighting value and the second weighting value corresponding to the non-negative factorized covariance matrix.

2. The method as claimed in claim 1, further comprising:

determining a fourth audio signal associated with the at least one frequency band by subtracting the third audio signal from the first audio signal; and determining a fifth audio signal associated with the at least one frequency band by subtracting the third audio signal from the second audio signal.

3. The method as claimed in claim 2, wherein the fourth audio signal is a left channel audio signal, the fifth audio signal is a right channel audio signal, the third channel is a center channel audio signal, the first audio signal is a left stereo audio signal, and the second audio signal is a right stereo audio signal.

4. The method as claimed in claim 1, further comprising:

determining an ambient audio signal associated with the at least one frequency band by subtracting the product of the second weighting value and the first audio signal from the product of the first weighting value and the second audio signal.

5. The method as claimed in claim 4, further comprising:

determining a left surround and right surround audio signal associated with the at least one frequency band by comb filtering the ambient audio signal associated with the at least one frequency band.

6. The method as claimed in claim 1, further comprising:

filtering each of the first and second audio signals to generate a lower and upper frequency part for each of the first and second audio signals;

generating at least one frequency band corresponding to the lower frequency part for each of the first and second audio signals.

7. The method as claimed in claim 6, further comprising:

determining a third audio signal associated with the upper frequency part of the first and second audio signals by combining the product of at least one first weighting value associated with the at least one frequency band and the first audio signal associated with the upper frequency part to the at least one second weighting value associated with the at least one frequency band and the second audio signal associated with the upper frequency part.

8. The method as claimed in claim 7, further comprising:

combining the third audio signal associated with the upper frequency part with the third audio signal associated with the at least one frequency band.

9. The method as claimed in claim 1, wherein the non-negative factorizing the covariance matrix to determine at least one first weighting value and at least one second weighting value associated with the at least one frequency band comprises at least one of:

a non-negative factorization with a minimization of a Euclidean distance; and a non-negative factorization with a minimization of a divergent cost function.

10. The method as claimed in claim 1, wherein the non-negative factorizing the covariance matrix generates the factors WH and wherein the at least one first weighting value and at least one second weighting value are the first and second columns of the conjugate transposed W vector.

11. An apparatus comprising at least one processor and at least one memory including computer program code the at least one memory and the computer program code configured to, with the at least one processor, cause the apparatus at least to perform:

determine a covariance matrix for at least one frequency band of a first and a second audio signal, wherein the covariance matrix comprises a cross correlation coefficient between the first and the second audio signal;

non-negative factorize the covariance matrix, based on the cross correlation coefficient, to determine at least one first weighting value and at least one second weighting value associated with the at least one frequency band;

determine a third audio signal associated with the at least one frequency band by combining the first weighting value and the first audio signal to the second weighting value and the second audio signal, and generate a plurality of channels from the first weighting value and the second weighting value corresponding to the non-negative factorized covariance matrix.

12. The apparatus of claim 11, further caused to perform:

determine a fourth audio signal associated with the at least one frequency band by subtracting the third audio signal from the first audio signal; and determine a fifth audio signal associated with the at least one frequency band by subtracting the third audio signal from the second audio signal.

13. The apparatus of claim 12, wherein the fourth audio signal is a left channel audio signal, the fifth audio signal is a right channel audio signal, the third channel is a center channel audio signal, the first audio signal is a left stereo audio signal, and the second audio signal is a right stereo audio signal.

14. The apparatus of claim 11, further caused to perform:

determine an ambient audio signal associated with the at least one frequency band by subtracting the product of the second weighting value and the first audio signal from the product of the first weighting value and the second audio signal.

15. The apparatus of claim 14, further caused to perform:

determine a left surround and right surround audio signal associated with the at least one frequency band by comb filtering the ambient audio signal associated with the at least one frequency band.

16. The apparatus of claim 11, further caused to perform:

filter each of the first and second audio signals to generate a lower and upper frequency part for each of the first and second audio signals;

generate at least one frequency band from the lower frequency part for each of the first and second audio signals.

17. The apparatus of claim 16, further caused to perform:

determine a third audio signal associated with the upper frequency part of the first and second audio signals by combining the product of at least one first weighting value associated with the at least one frequency band and the first audio signal associated with the upper frequency part to the at least one second weighting value associated with the at least one frequency band and the second audio signal associated with the upper frequency part.

18. The apparatus of claim 17, further caused to perform:

combine the third audio signal associated with the upper frequency part with the third audio signal associated with the at least one frequency band.

19. The apparatus of claim 11, caused to perform the non-negative factorizing the covariance matrix to determine at least one first weighting value and at least one second weighting value associated with the at least one frequency band is further caused to perform at least one of:

a non-negative factorization with a minimization of a Euclidean distance; and a non-negative factorization with a minimization of a divergent cost function.

20. The apparatus of claim 11, caused to perform the non-negative factorizing the covariance matrix further caused to perform: generating the factors WH and wherein the at least one first weighting value and at least one second weighting value are the first and second columns of the conjugate transposed W vector.

* * * * *